US005240828A

United States Patent [19]

Janusonis et al.

[11] Patent Number: 5,240,828

[45] Date of Patent: Aug. 31, 1993

[54] DIRECT REVERSAL EMULSIONS

[75] Inventors: Gaile A. Janusonis; Francis R. Hilton, Jr., both of Rochester; Richard D. Lucitte, Holcomb; Woodrow G. McDugle, Rochester; Roger Lok, Hilton; David Erdtmann, Rochester, all of N.Y.

[73] Assignee: Eastman Kodak Company, Rochester, N.Y.

[21] Appl. No.: 580,401

[22] Filed: Sep. 10, 1990

Related U.S. Application Data

[63] Continuation-in-part of Ser. No. 455,688, Dec. 22, 1989, abandoned.

[51] Int. Cl.[5] ..... G03C 1/06

[52] U.S. Cl. ..... 430/605; 430/597; 430/596; 430/598; 430/604; 430/606; 430/949; 430/567; 430/569

[58] Field of Search ..... 430/597, 596, 598, 604, 430/606, 605, 949, 567, 569

[56] References Cited

U.S. PATENT DOCUMENTS

| | | | |
|---|---|---|---|
| 3,656,961 | 4/1972 | Hayakawa et al. | 430/596 |
| 4,126,472 | 11/1991 | Sakai et al. | 430/264 |
| 4,444,874 | 4/1984 | Silverman et al. | 430/409 |
| 4,828,962 | 9/1989 | Grzeskowiak et al. | 430/569 |
| 4,835,093 | 5/1989 | Janusonis et al. | 430/567 |
| 4,849,326 | 7/1989 | Besio et al. | 430/512 |
| 4,945,035 | 7/1990 | Keevert et al. | 430/606 |
| 5,045,444 | 9/1991 | Bahnmuller et al. | 430/606 |
| 5,070,008 | 12/1991 | Maekawa et al. | 430/605 |

FOREIGN PATENT DOCUMENTS

| | | | |
|---|---|---|---|
| 2508137 | 9/1975 | Fed. Rep. of Germany | 430/605 |

OTHER PUBLICATIONS

Research Disclosure, 17643, Dec. 1978, Item VI.H, p. 24.

Research Disclosure, vol. 308, Dec. 1989, Item 308,118, I-D and VI-B,F and G.

"The Role of Ionic Defects in the Radiation Physics of the Silver Halides and Their Exploitation in Photography", Cryst. Latt. Def. and Amorph. Mat., 1989, vol. 18, pp. 297-313, Gordon and Breach Science Publishers, Inc., U.K.

"The Mechanism of $Ir^{3+}$ Sensitization in Silver Halide Materials", International Congress of Photographic Science, University of Cambridge, Sep. 6-10, 1982.

Research Disclosure No. 17643, Dec. 1978, Item VI.H, p. 24.

*Primary Examiner*—Charles L. Bowers, Jr.
*Assistant Examiner*—Thomas R. Neville
*Attorney, Agent, or Firm*—Joshua G. Levitt

[57] ABSTRACT

Room light handleable direct reversal silver bromide emulsions, with up to 70 mole percent chloride, have a broad Dmin window when from $1\times10^{-6}$ to $1\times10^{-4}$ mole per silver mole of a polybromo coordination complex of iridium is incorporated in the silver halide grains. The emulsions are stabilized against deterioration on keeping with mercapto compounds.

8 Claims, No Drawings

DIRECT REVERSAL EMULSIONS

This application is a continuation-in-part of U.S. patent application Ser. No. 455,688 filed Dec. 22, 1989, now abandoned.

This invention relates to novel room-light handleable, direct-reversal emulsions, to the processes of making them and to photographic elements employing them.

In a particular aspect, it is directed to such emulsions stabilized against deterioration as a result of keeping.

Photographic elements which produce images having an optical density directly proportional to the amount of radiation received on exposure are said to be negative working. A positive photographic image can be formed by producing a negative photographic image and then forming a second photographic image which is a negative of the first negative, i.e., a positive image. A direct positive image is understood to be a positive image that is formed without first forming a negative image.

A common approach to forming direct positive images is to use photobleach emulsions, i.e. grains which are internally doped with electron trapping compounds, and fogging the grain surface either prior to exposure or during processing. When developed in a surface developer, i.e. one which will leave the latent image sites within the silver halide grain substantially unrevealed, grains which receive the actinic radiation exposure develop at a slower rate than those grains not imagewise exposed. The result is a direct positive silver image. Such materials are described, for example, in Berriman U.S. Pat. No. 3,367,778 and Carroll, "Iridium Sensitization: A Literature Review", Photographic Science and Engineering, Volume 24, Number 6, November/-December 1980, pages 265–267 at 266.

One use of direct positive emulsions is in high contrast duplicating materials intended for the graphic arts. Some such materials are low in photographic speed and are intended to be used under bright safelight or even ordinary room-light conditions. Such materials are referred to here as "room-light handleable" emulsions, elements, or materials. The term "room-light handleable" is intended to denote that the material can be exposed to a light level of 200 lux for several minutes without a significant loss in maximum density. Typically, such materials require on the order of 10,000 ergs per square centimeter for Dmin exposure. Room-light handleable duplicating materials are described in, for example, U.S. Pat. No. 4,814,263 issued Mar. 21, 1989 and Japanese Kokai 58/215643 published Dec. 15, 1983.

One problem associated with direct-positive emulsions is a phenomenon called "re-reversal" which limits the exposure latitude of the direct positive emulsion.

It will be appreciated that in those areas of a direct-positive element which receive no exposure maximum image density will be developed, while those areas in which minimum density is developed a greater amount of exposure is received. It has been observed that as the amount of exposure is increased beyond that required to yield minimum density, eventually an increase in density on development starts to occur and the emulsion then acts like a negative-working emulsion. This phenomenon is called re-reversal and the amount of exposure between that just required to provide minimum density and that beyond which an increase in minimum density starts to form is referred to as the minimum density window or Dmin window.

A broad Dmin window is particularly desirable in graphic arts, daylight handleable duplicating films because significant overexposure can occur during image manipulation stages. If the window is not sufficiently large undesirable density increases result.

As indicated by Berriman and Carroll, a common way of forming a direct-positive emulsion is to internally dope the silver halide grains with a Group VIII metal, such as iridium. However, the art has not recognized any significant difference between various sources of iridium ion as a dopant for silver halide emulsions in general or direct-positive emulsions in particular. Although Eachus et al. in a paper entitled "*The Mechanism of $Ir^{3+}$ Sensitization in Silver Halide Materials,*" University of Cambridge, Sep. 6–10, 1982, (subsequently amplified by "Eachus et al. in a paper entitled "*The Role of Ionic Defects in the Radiation Physics of the Silver Halides and Their Exploitation in Photography*", Cryst. Latt. Def. Amorph. Matl. 18, 297 (1989), report some differences in behavior of incorporated iridium compounds in silver halide emulsions, the effects of ligand structure and lattice composition on the breadth of the Dmin window in direct-positive elements was not recognized.

There remains a need for room-light handleable iridium doped direct-positive silver halide emulsions with a relatively broad Dmin window. In addition one or more of high contrast, low Dmin, high Dmax and good image quality are desirable.

We have found that the identity of the ligand of the iridium coordination complex, and its relation to the silver halide host, can influence the breadth of the Dmin window, contrast, image quality and other features. This may be due to the incorporation of the ligand into the silver grain, as recently recognized in Janusonis et al. U.S. Pat. No. 4,835,093 issued May 30, 1989, and related art, or may be due to other factors. In any event, the present invention provides a room-light handleable, direct positive, iridium doped silver halide emulsion having an extended Dmin window. In particular, we have discovered that the photographic properties of silver halide reversal emulsions can be improved for a variety of photographic applications by incorporation of certain iridium complexes as dopants in the silver halide grains. More specifically, a combination of designated iridium complexes, used as dopants, and of silver bromide grains or silver chlorobromide grains provide reversal emulsions of superior properties, especially those which apply to the slow, day-light handleable emulsions used for graphic arts applications needing a large Dmin window, and high contrast.

In a further aspect we have found that, if a stabilizer is used to prevent deterioration of the emulsion on keeping, not all compounds are effective maintaining the breadth of the Dmin window.

Thus, in a preferred embodiment, the emulsion contains a stabilizer compound.

Thus in accordance with one aspect of this invention, there is provided a room-light handleable direct-positive silver halide emulsion comprising silver bromide grains containing up to 70 mole percent chloride, based on silver, doped with from $1\times10^{-6}$ to $1\times10^{-4}$ mole per silver mole, a polybromo coordination complex of iridium with two or more bromo ligands and the remaining ligands selected from aquo, chloro, fluoro, iodo, and nitrosyl. Preferred are complexes with four or more bromo ligands, and especially preferred are hexabromo complexes.

In another aspect this invention provides photographic elements comprising a support bearing a layer of an emulsion as described above.

In yet another aspect, this invention provides a process of forming a room-light handleable direct-positive silver halide emulsion which comprises precipitating silver halide grains by bringing together in a reaction vessel containing an aqueous dispersing medium:

a) a source of silver ions, b) a source of halide ions comprising 30 mole percent or greater bromide ions, any remaining halide being chloride, and c) a source or iridium, wherein the iridium is introduced into the vessel prior to the addition of 50% of the silver and preferably prior to addition of 10% of the silver by the addition of from $1\times10^{-6}$ to $1\times10^{-4}$ mole per mole silver of a polybromo coordination complex of iridium with two or more bromo ligands with the remaining ligands being selected from aquo, chloro, fluoro, iodo, and nitrosyl. Preferred are complexes with four or more bromo ligands, and especially preferred are hexabromo complexes.

The emulsions of the present invention can be prepared by combining in a reaction vessel containing an aqueous dispersing medium, (typically a dilute solution of gelatin), a source of silver ion, (typically silver nitrate) and a source of halide ion (typically an ammonium or alkali metal halide such as potassium bromide with up to 70 mole percent potassium chloride).

The iridium compound can be present in the reaction vessel prior to introduction of the silver salts but preferably is added together with those salts as a separate solution or added to the halide salt solution as the latter is added to the reaction vessel.

In order for the iridium to be incorporated at a location in the grain which provides a direct positive emulsion, all of the iridium should be below the surface of the grains. This is best accomplished by adding to the reaction mixture prior to addition of 50% of the silver ion, and preferably prior to addition of 10% of the silver ion.

Typically the reaction is performed in a stirred vessel maintained at an elevated temperature up to 70° C. although a lower temperature up to 50° C. is preferred, into which the sources of silver and halide ions are separately introduced. The size and growth rate of the emulsion grains are controlled by such factors as the concentration and rate of addition of the reactants and the time and way in which they are held (ripened) after precipitation of the grains is completed. Detailed procedures and equipment for precipitation of silver halide grains are described in the references referred to in Research Disclosure 17643, pages 22-31 of Volume 176 December 1978, entitled "Photographic Silver Halide Emulsions, Preparations, Addenda, Processing and Systems."

A typical process for the preparation of an emulsion of this invention is described in Example 1 which follows.

The silver halide grains are comprised of silver bromide with up to 70 mole percent chloride. Preferably, the emulsion contains no more than 50 mole percent silver chloride and most preferably is pure silver bromide.

The amount of iridium incorporated in the grain is typically in the range $1\times10^{-6}$ to $1\times10^{-4}$ mole iridium per mole silver. Preferred amounts are $5\times10^{-6}$ to $3\times10^{-5}$ mole iridium per mole silver.

The grains can take any common form and habit and hence include three-dimensional grains such as described in Berriman U.S. Pat. No. 3,367,778 and Illingsworth U.S. Pat. Nos. 3,501,305, 3,501,306 and 3,501,307 as well as tabular grains sensitized in a similar manner. The size and dispersity of the grains can be any known in the art. Preferably the emulsions are monodispersed and have a mean grain size of less than 0.7 μm and optimally less than 0.3 μm.

As indicated above, the identity of the ligand associated with the iridium will affect the breadth of the Dmin window. However, the identity of the counterion is not critical. A preferred counterion is potassium, although other monovalent counterions can be employed such as sodium, ammonium, rubidium, cesium, and the like.

$Z_3\ Ir\ Br_6$ $Z_2\ Ir\ (H_2O)\ Br_5$ $Z\ Ir\ (H_2O)_2\ Br_4$ $Z_3\ Ir\ Cl\ Br_5$ $Z_3\ Ir\ Cl_2\ Br_4$ $Z_3\ Ir\ Cl_3\ Br_3$ $Z_3\ Ir\ Cl_4\ Br_2$ $Z_3\ Ir\ I\ Br_5$ $Z_3\ Ir\ I_2\ Br_4$ $Z_3\ Ir\ I_3\ Br_3$ $Z_3\ Ir\ I_4\ Br_2$ $Z_3\ Ir\ F\ Br_5$ $Z_3\ Ir\ F_2\ Br_4$ $Z_3\ Ir\ F_3\ Br_3$ $Z_3\ Ir\ F_4\ Br_2$ $Z\ Ir\ (NO)\ Br_5$ $Z\ Ir\ (NO)\ Br_4\ Cl$ $Z\ Ir\ (NO)\ Br_4\ I$ $Z\ Ir\ (NO)\ Br_4\ F$ $Z\ Ir\ (NO)\ Br_3\ Cl_2$ $Z\ Ir\ (NO)\ Br_3\ I_2$ $Z\ Ir\ (NO)\ Br_3\ F_2$ $Z\ Ir\ (NO)\ Br_2\ Cl_3$ $Z\ Ir\ (NO)\ Br_2\ I_3$ $Z\ Ir\ (NO)\ Br_2F_3$ where Z is a monovalent counterion as described above. Comparable Ir (IV) compounds can be used except for the nitrosyl compounds.

The silver halide emulsions can be spectrally sensitized with sensitizers used for spectral sensitization of negative or positive working emulsions such as those described in Research Disclosure Item 17643, cited above. Preferably, the emulsion is spectrally unsensitized, for roomlight handling materials.

The emulsion are surface fogged with known reducing agents, such as thiourea dioxide, amine boranes, borohydrides, tin compounds, and other known ways.

The emulsions can be stabilized by use of stabilizing compounds which contain mercapto groups, such as mercaptotetrazoles, mercaptobenzoxazoles, mercaptooxazoles, mercaptooxadiazoles, mercaptothiazoles, mercaptobenzothiazoles, mercaptotriazoles, mercaptobenzimidazoles and nitrothiophenols. Especially preferred are heterocyclic mercapto stabilizers that contain nitro or carboxy groups, since these compounds do not significantly diminish the large Dmin window otherwise obtained with this invention. The most preferred are the nitro group containing oxazoles and benzoxazoles. The stabilizing compound is added to the emulsion after precipitation in an amount of about $1\times10^{-4}$ to $5\times10^{-3}$ moles per mole of silver. The preferred mercapto stabilizers for these emulsions are expected to have similar benefits for other emulsions, such as those doped with rhodium, ruthenium, rhenium and osmium. Moreover, certain preferred stabilizers provide enhanced safelight handleability to the emulsions. Exemplary stabilizers are the following compounds or their salts of monovalent metals such as silver, gold, potassium, sodium or lithium:

4-nitrophenyl-5-mercaptotetrazole
3-nitrophenyl-5-mercaptotetrazole
2-nitrophenyl-5-mercaptotetrazole
4-nitronaphthyl-5-mercaptotetrazole
4-methyl-5-nitro-2-mercaptooxazole
4-nitro-2-mercaptooxazole
2-mercaptobenzoxazole
5-nitro-2-mercaptobenzoxazole
6-nitro-2-mercaptobenzoxazole
7-nitro-2-mercaptobenzoxazole
4-nitro-2-mercaptobenzoxazole
5-nitro-2-mercaptooxadiazole
4-methyl-5-nitro-2-mercaptothiazole
4-methyl-5-nitro-2-mercaptobenzothiazole.

The stabilizing compounds can contain additional substitutents, additional groups, or their combinations, such as one or more nitro, cyano, alkyl, methoxy, carboxy, acetyl, acetamido, aryl, arylalkyl, nitroaryl, and the like.

The combination of the described stabilizers and certain electron trapping compounds such as pinacryptol yellow or 6-nitrobenzimidazole, also provides good stability and a large Dmin window; larger than could be obtained with a mercapto stabilizer alone.

These compounds can be added to the emulsion or to another layer of the element, such as an overcoat.

The emulsion commonly comprises a gelatin vehicle, although other vehicles can be employed in lieu of or together with gelatin.

Photographic elements of this invention comprise a layer of the emulsion coated on a support, preferably a transparent support such as polyethylene terephthalate.

In practice, images are formed with elements of the present invention by bringing the element into contact with a half-tone image to be duplicated and then exposing the element to high-intensity (typically 1500 watts) illumination from a metal halide light source for a period of time sufficient to trap the photo-electrons and generate photo-holes to photobleach the surface fog in the exposed areas, thus rendering the silver halide in these areas nondevelopable in a surface developer. Processing formulations and techniques are described in L. F. Mason, *Photographic Processing Chemistry*, Focal Press, London, 1966; *Processing Chemicals and Formulas*, Publication J-1, Eastman Kodak Company, 1973; *Photo-Lab Index*, Morgan and Morgan, Inc., Dobbs Ferry, N.Y., 1977, and *Neblette's Handbook of Photography and Reprography Materials, Processes and Systems*, VanNostrand Reinhold Company, 7th Ed., 1977.

The term "surface developer" encompasses those developers which will reveal the surface latent image centers on a silver halide grain, but will not reveal substantial internal latent image centers in an internal latent image forming emulsion under the conditions generally used to develop a surface sensitive silver halide emulsion. The surface developers can generally utilize any of the silver halide developing agents or reducing agents, but the developing bath or composition is generally substantially free of a silver halide solvent (such as water soluble thiocyanates, water soluble thioethers, thiosulfates, and ammonia) which will disrupt or dissolve the grain to reveal substantial internal image. Low amounts of excess halide are sometimes desirable in the developer or incorporated in the emulsion as halide releasing compounds, but high amounts of iodide or iodide releasing compounds are generally avoided to prevent substantial disruption of the grain.

Typical silver halide developing agents which can be used in the developing compositions of this invention include hydroquinones, catechols, aminophenols, 3-pyrazolidinones, ascorbic acid and its derivatives, reductones, phenylenediamines, or combinations thereof. The developing agents can be incorporated in the photographic elements wherein they are brought into contact with the silver halide after imagewise exposure; however, in certain embodiments they are preferably employed in the developing bath.

Once a silver image has been formed in the photographic element, it is conventional practice to fix the undeveloped silver halide.

The following examples further illustrates this invention.

EXAMPLE 1

Preparation of Emulsion with $K_3Ir\ Br_6$ (Invention).

The reaction vessel contained 24 g of gelatin per final Ag mole and 450 ml distilled water per Ag mole, and was maintained at 50° C. To this solution 0.09 g of 3,6-dithia-1,8-octane diol per Ag mole was added and stirred 5 min.

pAg was adjusted to 8.13 with 3M KBr solution and pH to 3.0 with 3M $HNO_3$.

A 3.0M $AgNO_3$ solution was run (at 133.3 ml/min) simultaneously with 3.0M NaBr solution (at 133.5 ml/min) into the reaction vessel for 30 min., maintaining the pAg at 8.13.

A fresh solution was prepared by dissolving 15.78 mg of $K_3IrBr_6$ per 1 ml of distilled water and one ml of the solution was added per Ag mole to the reaction vessel within the first 10 sec of precipitation (a 10 sec duration of addition) from a third jet to the mixer head. This incorporated $2\times10^{-5}$ mole $K_3IrBr_6$ per silver mole into the grains. The emulsion was cooled to 40° C. The pH adjusted to 4.5, and the emulsion was washed by ultrafiltration for about 60 min. The emulsion was then concentrated to 0.6 kg/Ag mole. Additional gelatin was added to a total of 40 g/Ag mole. PAg was adjusted (with 1M NaBr) to 7.7 and pH was adjusted to 5.0 with NaOH.

Resultant emulsion grain size was 0.25 μm (cube edge).

EXAMPLE 2

Preparation of Emulsion with 20 mppm $K_2IrCl_6$ (Comparison)

An emulsion was made the same way as in Example 1 except that it was doped with 20 mppm of $K_2Ir\ Cl_6$. The dopant solution was prepared by dissolving 4 mg of $K_2IrCl_6$ per ml of 4N $HNO_3$. The emulsion was doped by adding 2.4 ml of the solution per silver mole. Emulsion grain size was 0.24 μm (cube edge).

EXAMPLE 3

Preparation of Emulsion with $K_3IrBr_6$ (Invention)

The emulsion was made the same way as in Example 1, except that it was doped with 10 mppm of $K_3IrBr_6$. The dopant solution was prepared by dissolving 15.78 mg of $K_3IrBr_6$ per ml of distilled water and it was added fresh at 0.5 ml per silver mole during the precipitation of the emulsion, as indicated in Example 1. The resultant grain size was 0.24 μm (cube edge).

EXAMPLE 4

Preparation of Emulsion with $K_2IrCl_6$ (Comparison)

An emulsion was prepared as in Example 1 except that it was doped with 10 mppm $K_2IrCl_6$. The dopant solution was prepared the same way as in Example 2, and it was added to the emulsion at 1.2 ml per silver mole. The grain size was 0.26 μm (cube edge).

EXAMPLE 5

Preparation of Emulsion with $K[IrCl_4(H_2O)_2]$ (Comparison)

An emulsion was prepared the same way as in Example 1, except that it was doped with 10 mppm of $K[IrCl_4(H_2O)_2]$. The dopant solution was prepared by dissolving 20 mg of $K_3IrCl_6$ per one ml of water and heating it until two halide ligands were replaced by water molecules as evidenced by characteristic absorption maxima of the type described in I.A. Poulsen and C. S. Garner, *J. Am. Chem. Soc.* 84, 2032 (1962), and J. C. Chang and C. S. Garner, *Inorganic Chem.* 4, 209 (1965).

The emulsion was doped by adding 0.261 ml of this solution per silver mole. Grain size was 0.23 μm (cube edge).

EXAMPLE 6

Preparation of Emulsion with $K_3IrBr_6$ (Invention)

The emulsion was precipitated as in Example 1 except that the pAG was decreased throughout the precipitation, from 8.4 at the start to 7.9 at the end. The $K_3IrBr_6$ dopant was dissolved in pH=3, 3M KBr solution and was added during the first minute of the run mixed with the halide salts as they were added to the reaction vessel. The resultant grain size was 0.26 μm.

EXAMPLE 7

Preparation of Emulsions with $K_2IrCl_6$ (Comparison)

Emulsions were made as described in Example 6, except that they were doped with 5, 20, and 40 mppm of $K_2IrCl_6$. The dopant solution preparation was described in Example 2. The grain sizes were 0.23, 0.24, and 0.23 μm, respectively.

EXAMPLE 8

Preparation of Emulsions with $K[IrCl_4(H_2O)_2]$

The emulsions were made as in Example 6, except that they were doped with 20 and 40 mppm of $K(IrCl_4(H_2O)_2)$. The dopant solution preparation was described in Example 5. The grain sizes were 0.24 μm.

EXAMPLE 9

Preparation and Processing of Elements with Emulsions of Examples 1–8

The Emulsions in Table I were finished the following way:

Emulsions described in examples 1 and 2 were fogged with 0.75 mg of anhydrous potassium tetrachloroaurate and 40 mg of thioureadioxide per silver mole for 15 min at 70° C. at pH=6.0. The pAg was adjusted to 8.2 prior to the temperature rise. The finished emulsions were coated on a film support at 70 ml per $m^2$ and consisted of the following components per $m^2$:

- 3.8 g Ag
- 2.7 g gelatin
- 2.6 mg polyethylene glycol
- 78 mg (disodium salt of ethylenediamine tetraacetic acid dihydrate)
- 700 mg poly-co-(methyl-2-propionate)-co-(2-methyl-2-[(1-oxo-2-propenyl)amino]-1-propanesulfonic acid)-co-(3-oxo-2-[(2-methyl-1-oxo-2-propenyl)oxy]ethyl-butanoate Prior to coating the emulsion was adjusted to pH=4.5 and pAg=8.2. A gel layer of 1.4 g per $m^2$ was overcoated. These coatings are compared in Table I.

Emulsions in Table II (Examples 1 and 2) were fogged with 0.75 mg of anhydrous potassium tetrachloroaurate and 60 mg of thioureadioxide per silver mole in the same way as emulsions in Table I. They were coated containing the same addenda as emulsions in Table I, except that prior to coating, pH was adjusted to 6.0.

Emulsions in Table III (Examples 3, 4 and 5) were fogged and coated the same way as emulsions in Table I except that prior to coating the pH was adjusted to 6.0.

Emulsions in Table IV were fogged, coated and processed in the same way as emulsions in Table II, except that prior to coating the pH was adjusted to 5.5.

Emulsions in Table V were fogged, coated and processed in the same way as emulsion in Table IV, except that 0.05 mg of anhydrous potassium tetrachloroaurate were used per silver mole and the pAg was adjusted to 7.76 prior to fogging.

The elements were exposed and processed as follows:

The film was placed in contact with a 0.10 density increment carbon step wedge and exposed to 1000 W metal halide lamp with sufficient exposure time to produce reversal and negative response on the same sample of film.

It was then conventionally processed in a KODAK K65A Rapid Access Processor with KODAK RA2000 Rapid Access Developer for 22 seconds at 32 degrees C. From the exposed and processed elements curves were generated of density values of discrete exposure steps vs. exposure increments. The Dmin window was determined from these curves by measuring the log exposure range between 0.01 density on the reversal curve to 0.01 density on the negative curve.

The results obtained are shown in Tables I–V below. From these results it will be observed that the Dmin window for emulsions doped in accordance with the invention, i.e. Examples 1, 3 and 6 have a significantly wider Dmin window than those doped with comparison dopants.

TABLE I

Dmin Window Dependence on Dopant

| Emulsion | Dopant (20-mppm) | Dmax | Dmin | Speed @ 4.0 D[1] | Average[2] Contrast | LSC[3] | Dmin[4] Window |
|---|---|---|---|---|---|---|---|
| Example 1 | $K_3IrBr_6$ | 6.2 | 0.039 | 348 | 4.9 | 2.9 | 1.60 |
| Example 2 | $K_2IrCl_6$ | 6.1 | 0.040 | 354 | 4.6 | 2.8 | 1.10 |

[1]Speed measured at net specified density
[2]Average Contrast measured by taking a slope between 0.10 and 2.50 Net Density
[3]Lower Scale Contrast measured by taking a slope between 0.10 and 0.60 Net Density
[4]Measurement of separation between the positive and negative sensitometric images measured at 0.01 above Dmin in Log E units

TABLE II

| Emulsion | Dopant (20-mppm) | Dmax | Dmin | Speed @ 4.0 D[1] | Average[2] Contrast | LSC[3] | Dmin[4] Window |
|---|---|---|---|---|---|---|---|
| Example 1 | $K_3IrBr_6$ | 6.1 | 0.041 | 303 | 4.8 | 3.1 | 1.55 |
| Example 2 | $K_2IrCl_6$ | 6.2 | 0.045 | 303 | 4.6 | 2.8 | 0.65 |

[1]Speed measured at net specified density
[2]Average Contrast measured by taking a slope between 0.10 and 2.50 Net Density
[3]Lower Scale Contrast measured by taking a slope between 0.10 and 0.60 Net Density
[4]Measurement of separation between the positive and negative sensitometric images measured at 0.01 above Dmin in Log E units

TABLE III

| Emulsion | Dopant (20-mppm) | Speed @ 4.0 D[1] | Average[2] Contrast | LSC[3] | Dmin[4] Window |
|---|---|---|---|---|---|
| Example 3 | $K_3IrBr_6$ | 390 | 5.2 | 4.0 | 1.8 |
| Example 4 | $K_2IrCl_6$ | 394 | 4.6 | 3.1 | 0.95 |
| Example 5 | $K[IrCl_4(H_2O)_2]$ | 385 | 2.0 | 1.1 | * |

*Toe Contrast too low for meaningful measurement
[1]Speed measured at net specified density
[2]Average Contrast measured by taking a slope between 0.10 and 2.50 Net Density
[3]Lower Scale Contrast measured by taking a slope between 0.10 and 0.60 Net Density
[4]Measurement of separation between the positive and negative sensitometric images measured at 0.01 above Dmin in Log E units

TABLE IV

| Emulsion | Dopant | mppm | Dmax | Dmin | Speed[1] at 4.0 D | Average[2] Contrast | LSC[3] | Dmin[4] Window |
|---|---|---|---|---|---|---|---|---|
| Example 6 | $K_3IrBr_6$ | 20 | 5.8 | 0.035 | 275 | 5.3 | 5.3 | 1.4 |
| Example 7 | $K_2IrCl_6$ | 5 | 5.8 | 0.06 | 271 | 5.3 | 3.1 | 1.1 |
| " | " | 20 | 5.8 | 0.038 | 284 | 5.5 | 4.9 | 0.8 |
| " | " | 40 | 5.8 | 0.037 | 271 | 4.9 | 3.4 | 0.55 |
| Example 8 | $K(IrCl_4(H_2O)_2)$ | 20 | 5.8 | 0.094 | 275 | 3.8 | 1.9 | * |
| " | " | 40 | 5.8 | 0.057 | 268 | 4.4 | 3.2 | 1.15 |

*Toe Contrast too low for meaningful measurement
[1]Speed measured at net specified density
[2]Average Contrast measured by taking a slope between 0.10 and 2.50 Net Density
[3]Lower Scale Contrast measured by taking a slope between 0.10 and 0.60 Net Density
[4]Measurement of separation between the positive and negative sensitometric images measured at 0.01 above Dmin in Log E units

TABLE V

| Emulsion | Dopant | mppm | Dmax | Dmin | Speed[1] at 4.0 D | Average[2] Contrast | LSC[3] | Dmin[4] Window |
|---|---|---|---|---|---|---|---|---|
| Example 6 | $K_3IrBr_6$ | 20 | 5.8 | 0.04 | 283 | 6.0 | 3.9 | 1.45 |
| Example 7 | $K_2IrCl_6$ | 5 | 5.8 | 0.061 | 281 | 4.9 | 2.6 | 1.2 |
| " | " | 20 | 5.8 | 0.035 | 293 | 5.4 | 3.8 | 0.95 |
| " | " | 40 | 5.8 | 0.036 | 284 | 5.2 | 3.1 | 0.8 |
| Example 8 | $K(IrCl_4(H_2O)_2)$ | 20 | 5.8 | 0.088 | 286 | 3.3 | 1.7 | * |

TABLE V-continued

| Emulsion | Dopant | mppm | Dmax | Dmin | Speed[1] at 4.0 D | Average[2] Contrast | LSC[3] | Dmin[4] Window |
|---|---|---|---|---|---|---|---|---|
| " | " | 40 | 5.8 | 0.054 | 280 | 4.2 | 2.4 | 1.2 |

*Toe Contrast too low for meaningful measurement
[1]Speed measured at net specified density
[2]Average Contrast measured by taking a slope between 0.10 and 2.50 Net Density
[3]Lower Scale Contrast measured by taking a slope between 0.10 and 0.60 Net Density
[4]Measurement of separation between the positive and negative sensitometric images measured at 0.01 above Dmin in Log E units The following examples illustrate the effect of stabilizer variations or emulsions of this invention.

EXAMPLES 9-23

To samples of emulsions was added one of the stabilizers shown in the following Tables VI-VIII. The emulsions in Tables VIA and VIIIA were prepared as emulsions in Example 1, except that the grain size was adjusted to 0.21 μm. The emulsions were finished the same way as emulsions in Table V, except that the pAg was adjusted to 7.45 prior to the fogging step.

The emulsions in Tables VIB and VIIIB were prepared the same way as emulsions in Example 6, except that pAg=8.13 was held constant throughout the precipitation and the grain size was 0.16 μm. These emulsions were finished the same way as emulsions in Table V.

The emulsions in Table VII were precipitated the same way as in Example 6, except at a constant pAg=8.13. The grain size was adjusted to 0.20 μm. The emulsions were finished the same way as emulsions in Table V, except that the pAg was adjusted to 8.2 prior to the fogging step.

The emulsions were coated as described above and one portion of each coating was exposed and processed immediately while another portion was stored at 49° C. for 1 week, and then exposed and processed in the same way. The data reported in Tables VI-VIII show the effect of the stabilizer. While all coatings had a broadened Dmin window as a result of the use of the polybromoiridium dopant, mercapto stabilizers with nitro substituents were particularly effective in preventing deterioration in speed and density without reducing the Dmin window.

TABLE VI A

| Example | Stabilizer | mm/m | Keeping | Dmin | Dmax | Speed[1] at 0.1 D | LSC[3] | Dmin[4] Window |
|---|---|---|---|---|---|---|---|---|
| 9 | None | | Fresh | 0.058 | 6.2 | 191 | 4.1 | 1.52 |
| | | | Inc. | 0.046 | 5.9 | 210 | 3.7 | |
| 10 | 1-phenyl- | 1.0 | Fresh | 0.058 | 6.2 | 189 | 3.8 | 1.0 |
| | 5-mercaptotetrazole | | Inc. | 0.054 | 5.9 | 193 | 3.6 | |
| 11 | 1-(3-acetamidophenyl)- | 1.0 | Fresh | 0.064 | 6.2 | 190 | 3.7 | 1.13 |
| | 5-mercaptotetrazole | | Inc. | 0.053 | 5.9 | 193 | 3.6 | |

[1]Speed measured at net specified density
[3]Lower Scale Contrast measured by taking a slope between 0.10 and 0.60 Net Density
[4]Measurement of separation between the positive and negative sensitometric images measured at 0.01 above Dmin in Log E units

TABLE VI B

| Example | Stabilizer | mm/m | Keeping | Dmin | Dmax | Speed[1] at 0.1 D | LSC[3] | Dmin[4] Window |
|---|---|---|---|---|---|---|---|---|
| 12 | None | | Fresh | 0.040 | 6.5 | 209 | 3.5 | 1.7 |
| | | | Inc. | 0.041 | 6.2 | 228 | 3.5 | |
| 13 | 1-(3-acetamidophenyl)- | 1.0 | Fresh | 0.040 | 6.3 | 219 | 4.1 | 1.35 |
| | 5-mercaptotetrazole | | Inc. | 0.042 | 6.2 | 220 | 3.1 | |
| 14 | 1-(3,5-dicarboxyphenyl)- | 0.5 | Fresh | 0.040 | 6.5 | 232 | 3.8 | 1.5 |
| | 5-mercaptotetrazole | | Inc. | 0.042 | 6.2 | 233 | 3.7 | |
| 15 | 1-(4-nitrophenyl)- | 0.5 | Fresh | 0.041 | 6.5 | 215 | 4.6 | 1.55 |
| | 5-mercaptotetrazole | | Inc. | 0.042 | 6.2 | 215 | 3.2 | |
| | | 1.0 | Fresh | 0.045 | 6.3 | 233 | 4.3 | 1.7 |
| | | | Inc. | 0.041 | 6.2 | 234 | 4.7 | |

[1]Speed measured at net specified density
[3]Lower Scale Contrast measured by taking a slope between 0.10 and 0.60 Net Density
[4]Measurement of separation between the positive and negative sensitometric images measured at 0.01 above Dmin in Log E units

TABLE VII

| Example | Stabilizer | mm/m | Keeping | Dmin | Dmax | Speed[1] at 0.1 D | Speed[1] at 4.0 D | LSC[3] | Dmin[4] Window |
|---|---|---|---|---|---|---|---|---|---|
| 16 | None | | Fresh | 0.041 | 5.9 | 227 | 302 | 3.4 | 1.40 |
| | | | Inc. | 0.039 | 5.8 | 239 | 312 | 3.3 | |
| 17 | 2-mercapto- | 0.5 | Fresh | 0.040 | 5.5 | 229 | 300 | 4.1 | 1.22 |
| | benzoxazole | | Inc. | 0.039 | 5.7 | 231 | 306 | 3.9 | |
| 18 | 2-mercapto-5-nitro- | 0.5 | Fresh | 0.040 | 5.6 | 233 | 306 | 3.9 | 1.5 |
| | benzoxazole | | Inc. | 0.039 | 5.7 | 233 | 304 | 4.2 | |
| 19 | 5-(3-nitrophenyl)- | 0.5 | Fresh | 0.041 | 5.5 | 220 | 303 | 2.6 | 1.2 |

TABLE VII -continued

| Example | Stabilizer | mm/m | Keeping | Dmin | Dmax | Speed[1] at 0.1 D | Speed[1] at 4.0 D | LSC[3] | Dmin[4] Window |
|---|---|---|---|---|---|---|---|---|---|
| | 2-mercaptooxadiazole | | Inc. | 0.041 | 5.5 | 223 | 305 | 2.5 | |

[1]Speed measured at net specified density
[3]Lower Scale Contrast measured by taking a slope between 0.10 and 0.60 Net Density
[4]Measurement of separation between the positive and negative sensitometric images measured at 0.01 above Dmin in Log E units

TABLE VIIIA

| Example | Stabilizer | mm/m | Keeping | Dmin | Dmax | Speed[1] at 0.1 D | Speed[1] at 4.0 D | LSC[3] | Dmin[4] Window |
|---|---|---|---|---|---|---|---|---|---|
| 20 | None | | Fresh | 0.047 | 5.9 | 197 | 275 | 3.5 | 1.0 |
| | | | Inc. | 0.044 | 5.6 | 212 | 303 | 3.2 | |
| 21 | 4-hydroxymethyl- | 1.0 | Fresh | 0.088 | 5.9 | 181 | 261 | 3.5 | 0.40 |
| | 4-thiazoline-2-thione | | Inc. | 0.076 | 5.6 | 184 | 275 | 3.3 | |

[1]Speed measured at net specified density
[3]Lower Scale Contrast measured by taking a slope between 0.10 and 0.60 Net Density
[4]Measurement of separation between the positive and negative sensitometric images measured at 0.01 above Dmin in Log E units

TABLE VIIIB

| Example | Stabilizer | mm/m | Keeping | Dmin | Dmax | Speed[1] at 0.1 D | Speed[1] at 4.0 D | LSC[3] | Dmin[4] Window |
|---|---|---|---|---|---|---|---|---|---|
| 22 | None | | Fresh | 0.04 | 6.3 | 207 | 269 | 3.1 | 1.55 |
| | | | Inc. | 0.039 | 6.2 | 221 | 286 | 2.8 | |
| 23 | 4-methyl-5-nitro- | 1.0 | Fresh | 0.037 | 6.2 | 220 | 289 | 3.5 | 1.25 |
| | 4-thiazoline-2-thione | | Inc. | 0.039 | 6.4 | 217 | 285 | 3.6 | |

[1]Speed measured at net specified density
[3]Lower Scale Contrast measured by taking a slope between 0.10 and 0.60 Net Density
[4]Measurement of separation between the positive and negative sensitometric images measured at 0.01 above Dmin in Log E units The invention has been described in detail with particular reference to preferred embodiments thereof, but it will be understood that variations and modifications can be effected within the spirit and scope of the invention.

What is claimed is:

1. A room-light handleable, direct-positive silver halide emulsion, the emulsion requiring on the order of 10,000 ergs per square centimeter to provide minimum density and comprising silver bromide grains containing 50 mole percent bromide or greater, based on silver, doped with from $1\times10^{-6}$ to $1\times10^{-4}$ mole, per mole silver, of a polybromoiridium complex.

2. A silver halide emulsion of claim 1, wherein the polybromoiridium complex contains 4 or more bromo ligands, the remaining ligands being selected from fluoro, chloro, iodo, aquo and nitrosyl.

3. A room-light handleable, direct-positive silver halide emulsion, the emulsion requiring on the order of 10,000 ergs per square centimeter to provide minimum density and comprising silver bromide grains containing 50 mole percent bromide or greater, based on silver, doped with from $1\times10^{-6}$ to $1\times10^{-4}$ mole, per mole silver, of a hexabromoiridium complex.

4. A room-light handleable, direct-positive silver halide emulsion, the emulsion requiring on the order of 10,000 ergs per square centimeter to provide minimum density and comprising silver bromide grains containing 100 mole percent bromide, based on silver, doped with from $1\times10^{-6}$ to $1\times10^{-4}$ mole, per mole silver, of a hexabromoiridium complex.

5. A silver halide emulsion of claim 4, further comprising a stabilizer.

6. A room-light handleable, direct-positive silver halide emulsion, the emulsion requiring on the order of 10,000 ergs per square centimeter to provide minimum density and comprising silver bromide grains containing 100 mole percent bromide, based on silver, doped with from $1\times10^{-6}$ to $1\times10^{-4}$ mole, per mole silver, of a hexabromoiridium complex and further comprises a stabilizer which is a mercaptoheterocyclic compound substituted with one or more nitro compounds.

7. A silver halide emulsion of claim 6 further comprising an electron trapping agent.

8. A photographic element comprising a support bearing a layer of an emulsion of any one of claims 1, 3, 4 or 6.

* * * * *